US006777038B2

(12) United States Patent
Murasawa et al.

(10) Patent No.: US 6,777,038 B2
(45) Date of Patent: Aug. 17, 2004

(54) RECORDING MATERIAL FOR BACK PRINTING

(75) Inventors: Yukiko Murasawa, Kanuma (JP); Hideaki Takahashi, Kanuma (JP); Jun Takahashi, Kanuma (JP); Akio Ito, Kanuma (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/897,387

(22) Filed: Jul. 3, 2001

(65) Prior Publication Data

US 2002/0025445 A1 Feb. 28, 2002

(30) Foreign Application Priority Data

Jul. 13, 2000 (JP) ..... 2000-212811

(51) Int. Cl.[7] ..... B41M 5/40

(52) U.S. Cl. ..... 428/32.15; 428/32.26; 428/32.34

(58) Field of Search ..... 428/32.15, 32.26, 428/32.34, 195, 323

(56) References Cited

U.S. PATENT DOCUMENTS

| | | | | |
|---|---|---|---|---|
| 4,642,247 A | | 2/1987 | Mouri et al. | |
| 4,877,678 A | | 10/1989 | Hasegawa et al. | |
| 5,027,131 A | * | 6/1991 | Hasegawa et al. | 346/1.1 |
| 5,560,982 A | * | 10/1996 | Sato | 428/216 |
| 5,985,425 A | * | 11/1999 | Tomizawa et al. | 428/212 |
| 6,013,354 A | * | 1/2000 | Tomizawa et al. | 428/206 |
| 6,110,585 A | * | 8/2000 | Shaw-Klein | 428/341 |
| 6,139,940 A | * | 10/2000 | Iwamoto et al. | 428/195 |
| 6,177,181 B1 | * | 1/2001 | Hamada et al. | 428/304.4 |

FOREIGN PATENT DOCUMENTS

EP 0 286 427 A2 10/1988

* cited by examiner

*Primary Examiner*—Cynthia H. Kelly
*Assistant Examiner*—B. Shewareged
(74) *Attorney, Agent, or Firm*—Oliff & Berridge, PLC

(57) ABSTRACT

A recording material for back printing has a transparent substrate; an ink absorbing layer that is provided on the transparent substrate; and a porous ink transmitting layer that is provided on the ink absorbing layer and comprises a filler dispersed in a binder resin, where ink transmitting layer is crosslinked.

19 Claims, 1 Drawing Sheet

10

RECORDING MATERIAL FOR BACK PRINTING

BACKGROUND OF THE INVENTION

1. Field of the Invention

The present invention relates to a recording material for back printing.

2. Description of the Related Art

As shown in FIG. 1, a recording material for back printing 10 generally has a layered structure in which the following are built up in order: a transparent substrate 1 made of PET or the like; an ink absorbing layer 2; and a porous ink transmitting layer 3 comprising a filler dispersed in a binder resin.

With the recording material for back printing 10, an ink image is formed on the surface of the ink transmitting layer 3 by means of an ink jet printer or the like, and this ink image permeates through the ink transmitting layer 3 and is held by the ink absorbing layer 2. The ink image held in the ink absorbing layer 2 is viewed from the side of the transparent substrate 1.

However, with a printed article obtained by forming an ink image on a conventional recording material for back printing 10, there is a problem that if the printed article is used, for example, superposed on the back of a glass plate and water sticks to the ink transmitting layer 3 through dew condensation or the like, then this water will permeate through the ink transmitting layer 3 to the ink absorbing layer 2, causing the ink absorbing layer 2 to swell and move into the porous cavities in the ink transmitting layer 3, with the result that the transparent appearance and the color tones of the image, and so on, change. Furthermore, the swelling of the ink absorbing layer 2 will cause the adhesive strength between the ink absorbing layer 2 and the ink transmitting layer 3 to drop, in some cases leading to the ink transmitting layer 3 peeling away from the ink absorbing layer 2.

Moreover, there is also a problem that the ink transmitting layer 3 is easily scratched because it is porous.

SUMMARY OF THE INVENTION

In view of such problems, objects of the present invention are to increase the strength of the ink transmitting layer in a recording material for back printing, and to prevent the transparent appearance and the color tones of the image, and so on, from changing, when water sticks to the ink transmitting layer.

The inventors of the present invention discovered that by crosslinking the ink transmitting layer, the ink transmitting layer becomes stronger, and, moreover, the effects of crosslinking the ink transmitting layer extend at least as far as the region of the ink absorbing layer on the ink transmitting layer side, meaning that the phenomenon, in which the ink absorbing layer swells and moves into the porous cavities in the ink transmitting layer, can be suppressed.

The present invention thus provides a recording material for back printing that comprises: a transparent substrate; an ink absorbing layer that is provided on the transparent substrate; and a porous ink transmitting layer that is provided on the ink absorbing layer and comprises a binder resin and a filler dispersed therein, wherein the ink transmitting layer is crosslinked.

DETAILED DESCRIPTION OF THE INVENTION

Figure 1:
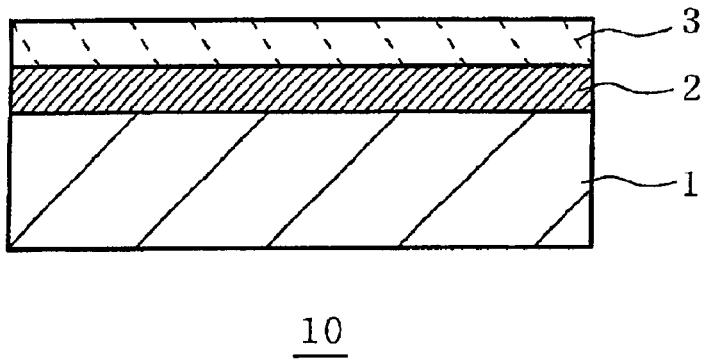
FIG. 1 is a cross-sectional view of a typical recording material for back printing.

Following is a detailed description of embodiments of the present invention.

The recording material for back printing of the present invention has a layered structure like that of the general recording material for back printing 10 shown in FIG. 1, in which a transparent substrate 1, an ink absorbing layer 2 and an ink transmitting layer 3 are built up in this order.

The ink transmitting layer 3 is a porous layer comprising a filler dispersed in a binder resin. The filler may be glass beads, silica, alumina, talc, calcium carbonate, or the like. Of these, it is preferable to use silica, since silica has a high degree of whiteness and is chemically stable.

Furthermore, the binder resin may be a polyester resin, a phenoxy resin, a polyvinyl alcohol resin, a polyvinyl butyral resin, polyvinyl acetate, a styrene-butadiene rubber, an acrylic resin, an acrylic emulsion, a polyamide resin, an epoxy resin, a polyvinyl acetal, polyethylene, polypropylene, an ionomer, a urethane resin, or the like. Of these, it is preferable to use a polyester resin, since polyester resins have low propensity for absorbing ink, high coated film strength, and high flexibility.

Regarding the proportions of the filler and the binder resin in the ink transmitting layer 3, in consideration of the ink permeability and the coated film strength, it is preferable for there to be 5 to 200 parts by weight of the binder resin per 100 parts by weight of the filler.

A characteristic of the present invention is that the ink transmitting layer 3 is crosslinked, giving the ink transmitting layer 3 improved water resistance.

The crosslinking method can be selected as appropriate in accordance with the type of binder resin, the type of filler, the type of resin in the ink absorbing layer, and so on. For example, if use is made of a polyvinyl acetal, a phenoxy resin or a polyester resin having active hydrogens, or the like, as the binder resin, then an isocyanate type or melamine type crosslinking agent can be used. Of these, an isocyanate type crosslinking agent is preferable, since it gives a stable crosslinking reaction. If use is made of a vinyl type resin, or the like, as the binder resin, then the crosslinking may be carried out by irradiating with an electron beam. Other possible crosslinking methods include irradiating with ultraviolet rays.

Regarding the extent of crosslinking, it is preferable to use a crosslinking agent in an amount less than an equivalent, this being from the point of view of preventing the ink absorbing ability of the ink absorbing layer 2 from falling.

Various additives such as whiteners, surfactants, pigments, ultraviolet absorbers, antioxidants and pH regulators may be contained in the ink transmitting layer 3.

There are no particular limitations on the thickness of the ink transmitting layer 3, but it is generally 5 to 30 $\mu$m.

The ink absorbing layer 2, on the other hand, is made from a resin capable of absorbing ink. Ink for back printing is generally hydrophilic, and so it is generally preferable for the ink absorbing layer 2 to be made from a hydrophilic resin, for example a water-soluble polyester resin, a polyvinyl pyrrolidone resin, a polyvinyl alcohol resin, a polyurethane resin, a polyvinyl acetal resin, an ethylene/vinyl acetate copolymer, an acrylic resin, or the like.

Moreover, various additives such as whiteners, surfactants, pigments, ultraviolet absorbers, antioxidants and pH regulators may be contained in the ink absorbing layer 2.

With the present invention, it is preferable for the ink absorbing layer 2 to be crosslinked at least in the region on the ink transmitting layer side. This will result in swelling of the ink absorbing layer 2 being suppressed in the case that water has passed through the ink transmitting layer 3 and permeated into the ink absorbing layer 2, meaning that movement of the ink absorbing layer 2 into the porous cavities in the ink transmitting layer 3 can be suppressed.

From the point of view of simplifying the manufacturing process, a preferable method for crosslinking the ink absorbing layer 2, at least in the region on the ink transmitting layer side, involves crosslinking of the ink absorbing layer 2 by a crosslinking agent, which was used in the formation of the ink transmitting layer 3, or by an electron beam, which was used when crosslinking the ink transmitting layer 3, or the like. When the ink absorbing layer 2 is crosslinked by the former, an example of a specific method is to apply a coating solution for ink absorbing layer formation, that does not contain the crosslinking agent, onto the transparent substrate and then dry in order to form an ink absorbing layer coating film, and to then apply a coating solution thereupon for ink transmitting layer formation that contains the crosslinking agent and leave for a predetermined period until the crosslinking is completely finished. In this case, the crosslinking agent and the material from which the ink absorbing layer 2 is formed are suitably selected in such a way that the crosslinking agent—which is added to crosslink the ink transmitting layer 3—also crosslinks the ink absorbing layer 2.

If the extent of crosslinking of the ink absorbing layer 2 is too high, then the ink absorbing ability will fall, and so, as stated earlier, it is preferable to make the amount of the crosslinking agent for crosslinking the ink transmitting layer 3 less than an equivalent.

There are no particular limitations on the thickness of the ink absorbing layer 2, but it is typically 5 to 30 $\mu$m.

The transparent substrate 1 may be, for example, a transparent film made of a polyester, polyethylene, polypropylene, a polyamide, polyvinyl chloride, a polycarbonate, or the like. There are no particular limitations on the thickness of the transparent substrate 1, but it is typically 10 to 500 $\mu$m.

The recording material for back printing of the present invention can be used with various image recording methods. For example, an image can be formed with an ink jet printer or the like, or with a fountain pen, felt-tipped pen, a pen plotter or the like.

EXAMPLES

Following is a concrete description of the present invention based on examples.

Example 1

(Formation of Ink Absorbing Layer)

A coating solution for ink absorbing layer formation was prepared by mixing the components listed in Table 1 together for 3 hours using a jar mill, and was then applied onto a 100 $\mu$m-thick transparent polyester film (Cosmoshine A4100 made by Toyobo) using a bar coater in such a way that the dried thickness would be about 13 $\mu$m. Drying was then carried out in a hot air circulating type furnace at 120° C. for 5 minutes, thus forming an ink absorbing layer.

TABLE 1

| Component | Parts by weight |
|---|---|
| Water-soluble polyester resin (NS-112L made by Takamatsu Yushi) | 58.3 |
| Polyvinyl pyrrolidone (Luviskol K-90 made by BASF) | 3.8 |
| Aluminum hydroxide (Hydiride H42 made by Showa Denko) | 2.5 |
| Ion-exchange water | 35.6 |

(Formation of Ink Transmitting Layer)

The components listed in Table 2 were mixed in a dissolver, thus dissolving the resin. 40 parts per weight of glass beads were then put in per 100 parts per weight of all the components listed in Table 2 combined and dispersion was carried out for 12 hours in a jar mill, thus obtaining a coating solution for ink transmitting layer formation. The coating solution for ink transmitting layer formation was then applied onto the above-mentioned ink absorbing layer using a coil bar in such a way that the dried thickness would be about 13 $\mu$m. After formation of the coating film, the resulting material was left for about 3 days, thus obtaining the recording material for back printing of the present example.

TABLE 2

| Component | Parts by weight |
|---|---|
| Silica (Mizucasil P527 made by Mizusawa Industrial Chemicals) | 16.5 |
| Polyester resin (Vylon 200 made by Toyobo) | 10.8 |
| Isocyanate (Takenate D-110N made by Takeda Chemical Industries) | 2.7 |
| MEK | 49 |
| Cyclohexanone | 21 |

Example 2

A recording material for back printing was prepared as in Example 1, only a phenoxy resin (Phenoto YP50 made by Toto Kasei ) was used in place of the polyester resin (Vylon 200 made by Toyobo) in the coating solution for ink transmitting layer formation.

Comparative Example 1

A recording material for back printing was prepared as in Example 1, only the polyester resin (Vylon 200 made by Toyobo) was used in place of the isocyanate (Takenate D-110N made by Takeda Chemical Industries) in the coating solution for ink transmitting layer formation.

Comparative Example 2

A recording material for back printing was prepared as in Example 1, only the phenoxy resin (phenote YP50 made by Toto Kasei ) was used in place of the isocyanate (Takenate D-110N made by Takeda Chemical Industries) in the coating solution for ink transmitting layer formation.

Evaluation

Solid printing was performed on each of the recording materials for back printing obtained in the above-mentioned Examples and Comparative Examples, using an ink jet printer (MJ8000C made by Seiko Epson) in glossy paper mode with pigment inks (SPC-0180K, SPC-0180C, SPC-0180M and SPC-0180Y made by Mimaki), and the following tests were carried out on the printed parts or unprinted parts as described below: (1) water resistance test; (2) pencil strength test; (3) transmission/reflection density test; (4) peel strength test. The results are shown in Table 3.

(1) Water Resistance Test:

A single drop of water was dropped onto the printed surface of a recording material for back printing upon which solid printing had been performed in glossy paper mode. The recording material was left sitting until it had dried, and was then observed and evaluated as follows.

Rank Criteria

A: The water drop leaves virtually no mark.

B: The water drop leaves a mark.

C: The ink absorbing layer and the ink transmitting layer peel away from one another.

(2) Pencil Strength Test

The pencil strength of the ink transmitting layer surface of an unprinted recording material for back printing was measured in accordance with JIS K5400.

(3) Transmission/Reflection Density Test:

The transmission density and reflection density of a recording material for back printing upon which solid printing had been performed in glossy paper mode were measured from the transparent substrate side using a Macbeth densitometer TR924.

(4) Peel Strength Test:

Cellophane adhesive tape was stuck onto the ink transmitting layer surface of an unprinted recording material for back printing, and then the peel strength was evaluated as follows according to how much the ink transmitting layer peeled off when the cellophane adhesive tape was suddenly torn off.

Rank Criteria

A: Hardly peels off at all

B: Partially peels off

C: Peels off

TABLE 3

| | (1) | (2) | (3) | | | | | | | | (4) |
|---|---|---|---|---|---|---|---|---|---|---|---|
| | Water | Pencil | Transmission density | | | | Reflection density | | | | Peel |
| | Resistance | strength | Y | M | C | K | Y | M | C | K | strength |
| Ex. 1 | A | B | 1.4 | 1.5 | 1.6 | 2.4 | 2.9 | 2.1 | 2.7 | 3.6 | A |
| Ex. 2 | A | HB | 1.6 | 1.6 | 1.9 | 2.5 | 2.8 | 1.7 | 2.1 | 2.8 | A |
| Comp. Ex. 1 | B | 2B | 1.5 | 1.3 | 1.4 | 2.2 | 3 | 2.1 | 2.7 | 3.5 | B |
| Comp. Ex. 2 | B | B | 1.5 | 1.5 | 1.8 | 2.5 | 2.7 | 1.5 | 1.7 | 2.3 | A |

It can be seen from the results in Table 3 that the water resistance and the pencil strength of the recording materials for back printing of Examples 1 and 2 in which an isocyanate crosslinking agent was included in the coating solution for ink transmitting layer are higher than those of the recording materials for back printing of Comparative Examples 1 and 2 for which an isocyanate was not included. It can also be seen that the recording materials for back printing of Examples 1 and 2 and the recording materials for back printing of Comparative Examples 1 and 2 have comparable transmission densities and reflection densities to one another, meaning that using the isocyanate does not result in a drop in image quality.

With the recording material for back printing of the present invention, the strength of the ink transmitting layer, when water sticks thereto, is increased, and the changes to the transparent appearance and the color tones of the image, and so on, when water sticks to the ink transmitting layer, can be prevented.

The entire disclosure of the specification, claims, summary and drawing of Japanese Patent Application No. 2000-212811 filed on Jul. 13, 2000 is hereby incorporated by the reference.

What is claimed is:

1. A recording material for back printing, comprising:

a transparent substrate;

a crosslinked ink absorbing layer that is provided on the transparent substrate; and a crosslinked porous ink transmitting layer, that includes a binder resin and a filler dispersed therein, is provided on the ink absorbing layer, wherein the ink transmitting layer is crosslinked to a greater extent than the ink absorbing layer.

2. The recording material for back printing according to claim 1, wherein the ink transmitting layer is crosslinked using a crosslinking agent.

3. The recording material for back printing according to claim 1, wherein the ink absorbing layer comprises a hydrophilic resin.

4. The recording material for back printing according to claim 2, wherein the ink absorbing layer comprises a hydrophilic resin.

5. The recording material for back printing according to claim 2, wherein the ink absorbing layer is crosslinked at least in the region on the ink transmitting layer side.

6. The recording material for back printing according to claim 3, wherein the ink absorbing layer is crosslinked at least in the region on the ink transmitting layer side.

7. The recording material for back printing according to claim 1, wherein the ink receiving layer comprises a hydrophobic resin.

8. The recording material for back printing according to claim 2, wherein the ink receiving layer comprises a hydrophobic resin.

9. The recording material for back printing according to claim 1, wherein the ink absorbing layer is crosslinked using a crosslinking agent.

10. The recording material for back printing according to claim 1, wherein the ink transmitting layer is crosslinked by irradiation with an electron beam.

11. The recording material for back printing according to claim 1, wherein the ink absorbing layer is crosslinked by irradiation with an electron beam.

12. The recording material for back printing according to claim 1, wherein the ink transmitting layer is crosslinked by irradiation with ultraviolet rays.

13. The recording material for back printing according to claim 1, wherein the ink absorbing layer is crosslinked by irradiation with ultraviolet rays.

14. The recording material for back printing according to claim 2, wherein the crosslinking agent is selected from the group consisting of an isocyanate type crosslinking agent and a melamine type crosslinking agent.

15. The recording material for back printing according to claim 9, wherein the crosslinking agent is selected from the group consisting of an isocyanate type crosslinking agent and a melamine type crosslinking agent.

16. The recording material for back printing according to claim 2, wherein the ink absorbing layer comprises a water-soluble polyester resin, polyvinyl pyrrolidone, aluminum hydroxide, and ion-exchange water.

17. The recording material for back printing according to claim 2, wherein the ink receiving layer comprises silica, a polyester resin or a phenoxy resin, isocyanate, MEK, and cyclohexanone.

18. The recording material for back printing according to claim 2, wherein the proportion of the binder to the filler is 5–200 parts by weight of the binder resin per 100 parts by weight of the filler.

19. The recording material for back printing according to claim 1, wherein the ink absorbing layer is crosslinked at least in the region on the ink transmitting layer side.

* * * * *